US006598240B1

(12) United States Patent
Chang et al.

(10) Patent No.: US 6,598,240 B1
(45) Date of Patent: Jul. 29, 2003

(54) TOILET SEAT DEVICE HAVING SUPPORT FOR CHILDREN

(76) Inventors: Hong Cheng Chang, P.O. Box 63-298, Shi Fu Road, Taichung (TW), 406; Tsung Fu Lin, P.O. Box 63-298, Taichung (TW), 406

( * ) Notice: Subject to any disclaimer, the term of this patent is extended or adjusted under 35 U.S.C. 154(b) by 0 days.

(21) Appl. No.: 10/307,386

(22) Filed: Nov. 26, 2002

(51) Int. Cl.[7] ..... A47K 13/00
(52) U.S. Cl. ..... 4/239; 4/235
(58) Field of Search ..... 4/239, 237, 235, 4/234

(56) References Cited

U.S. PATENT DOCUMENTS 806,176 A * 12/1905 Oakley ..... 4/239
1,217,506 A * 2/1917 Riihikoski ..... 4/239
1,287,177 A * 12/1918 Johnson ..... 236/58
2,752,610 A * 7/1956 Mabrey ..... 4/237
3,379,800 A 4/1968 Wert ..... 4/237
3,949,432 A 4/1976 Ginsburg ..... 4/237
5,787,518 A * 8/1998 Mendelovich et al. ..... 4/449
5,809,584 A * 9/1998 Potts ..... 4/254
6,067,666 A * 5/2000 Dixon ..... 4/239

* cited by examiner

*Primary Examiner*—Gregory Huson
*Assistant Examiner*—Huyen Le

(57) ABSTRACT

A toilet seat device includes an annular base member rotatably attached onto a toilet bowl, and a board for safely and stably supporting children on the annular base member. The board is coupled to the annular base member and supportable on a horizontal working position to support the feet of the children. A plate is rotatably coupled between the annular base member and the board. The plate and the board may be received in the annular base member. A panel may be secured to the board at a perpendicular position, to support the board at the horizontal working position.

7 Claims, 8 Drawing Sheets

TOILET SEAT DEVICE HAVING SUPPORT FOR CHILDREN

BACKGROUND OF THE INVENTION

1. Field of the Invention

The present invention relates to a toilet seat device, and more particularly to a toilet seat device having a support device for safely and stably supporting children.

2. Description of the Prior Art

Typical toilet seat devices comprise an annular seat member pivotally or rotatably secured on top of the toilet bowl, and having a greater opening sized for adults. When children are seated on the typical greater annular seat member, the feet of the children may not touch the ground or floor, such that the children may have a good chance to fall out of the bowl or the annular seat member. The typical toilet seat devices may not be provided to safely support the children.

The present invention has arisen to mitigate and/or obviate the afore-described disadvantages of the conventional toilet seat devices.

SUMMARY OF THE INVENTION

The primary objective of the present invention is to provide a toilet seat device including a support device for safely and stably supporting children.

In accordance with one aspect of the invention, there is provided a toilet seat device comprising an annular base member rotatably attached onto a toilet bowl and including an opening formed therein, and a device provided for safely and stably supporting children on the annular base member, such as for safely supporting the feet of the children. The annular base member may have the opening thereof sized to support either adults or children on the annular base member.

The supporting device includes a board coupled to the annular base member and movable to a horizontal working position to support the children, and a plate pivotally coupled between the annular base member and the board, and rotatable relative to the annular base member between a first position parallel to the annular base member and a second position perpendicular to the annular base member.

The annular base member includes a chamber formed therein and defined by a peripheral wall, to receive the plate in the chamber of the annular base member. The board is rotatably coupled to the plate with a rod, and rotatable relative to the plate between a first position parallel to the plate and a second position perpendicular to the plate.

A panel may be attached to the board, and receivable in the board, and movable out of the board to a position perpendicular to the board, to support the board at the horizontal working position. The board includes a spring latch engageable with the panel to secure the panel to the board. For example, the panel includes a projection rotatably secured to the board with a pole, the spring latch is engageable with the projection of the panel.

The projection of the panel includes a stop extended therefrom, the spring latch includes a catch extended therefrom and engageable with the stop of the projection of the panel. The spring latch includes a hand grip for actuating and disengaging the catch of the spring latch from the stop of the projection of the panel.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
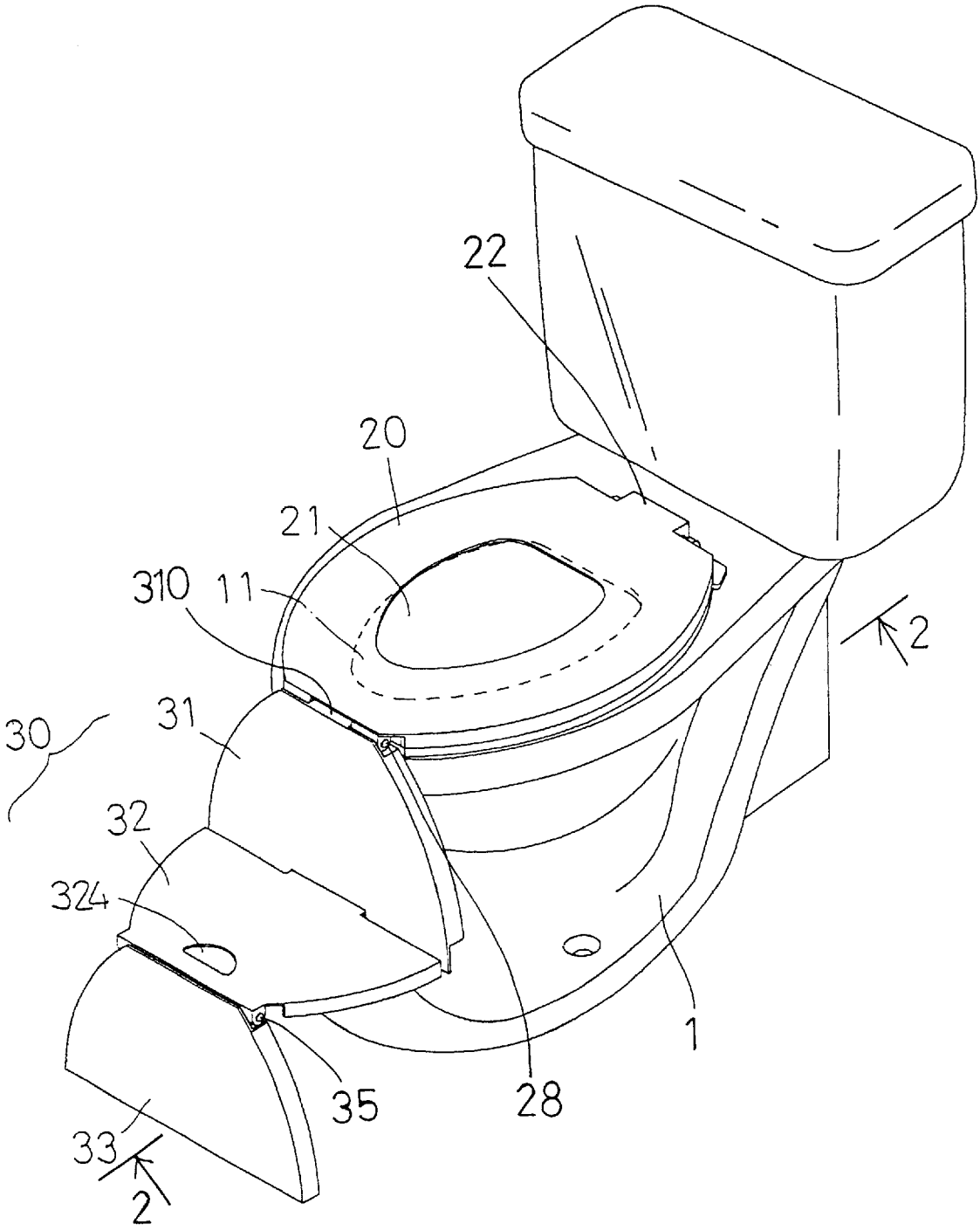
FIG. 1 is a perspective view of a toilet seat device having a support device in accordance with the present invention, in an open or working position.

Referring to the drawings, and initially to FIGS. 1–6, a toilet seat device in accordance with the present invention comprises a toilet bowl 1 including a bracket 2 provided thereon, such as provided on the rear and upper portion of the toilet bowl 1, and an annular seat member 10 including an opening 11 formed therein, and including one or more ears 12 provided on the rear portion thereof for rotatably or pivotally secured to the bracket 2 of the toilet bowl 1 with one or more pivot axles 3.

Figure 6:
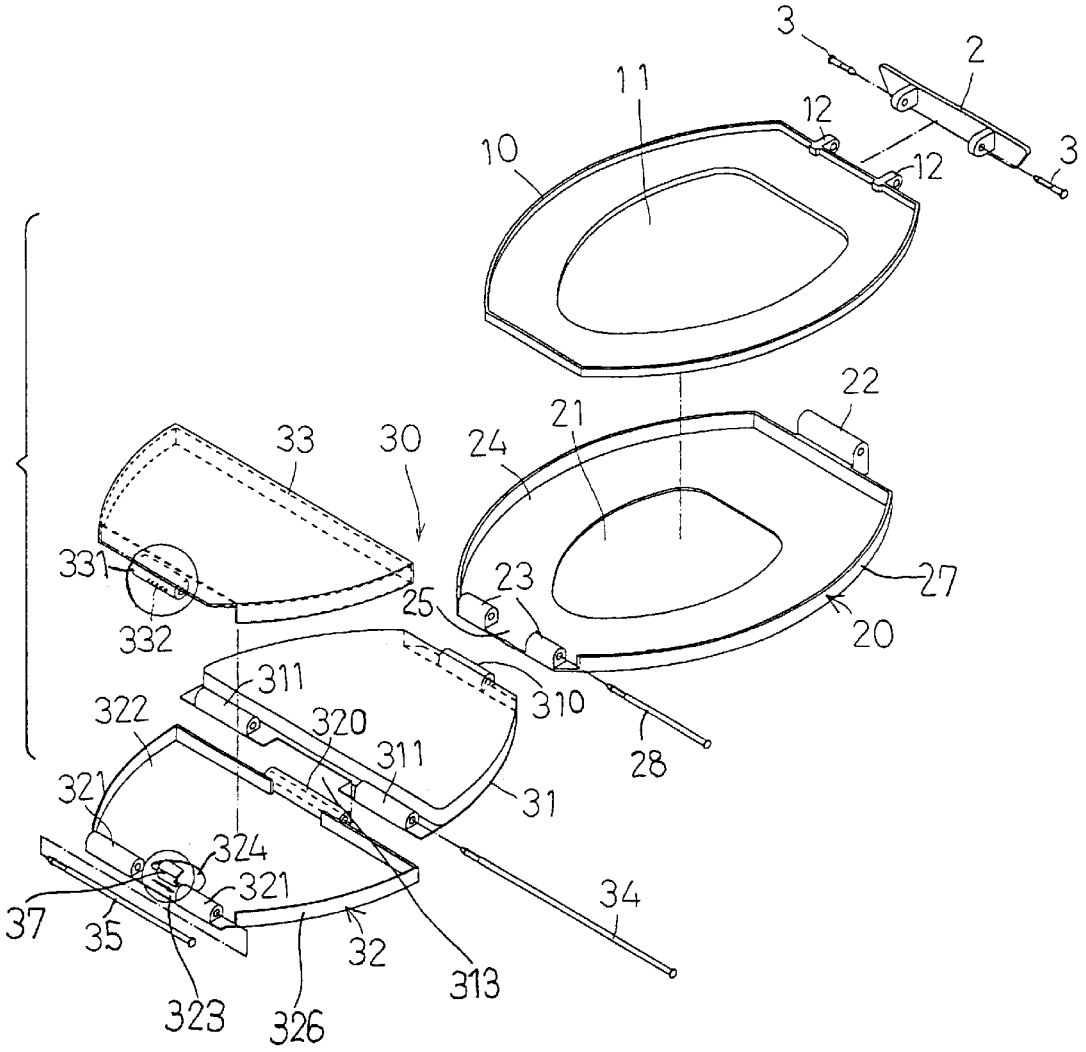
FIG. 6 is an exploded view of the support device for the toilet seat device, as seen from the bottom thereof.

The opening 11 of the annular seat member 10 is typical sized for adults, and is too large for children. For example, as shown in FIG. 6, the annular seat member 10 includes two ears 12 extended rearwardly from the rear portion thereof for rotatably or pivotally secured to the bracket 2 with the pivot axles 3, and thus for allowing the annular seat member 10 to be rotated relative to the toilet bowl 1.

The toilet seat device further includes a support device 30 having an annular base member 20 that includes an opening 21 of reduced area than that of the opening 11 of the annular seat member 10, for allowing the annular base member 20 to stably support children thereon. The annular base member 20 includes one or more projections 22 provided on the rear portion thereof, and rotatably secured to the bracket 2 of the bowl 1 with the pivot axles 3.

Figure 2:
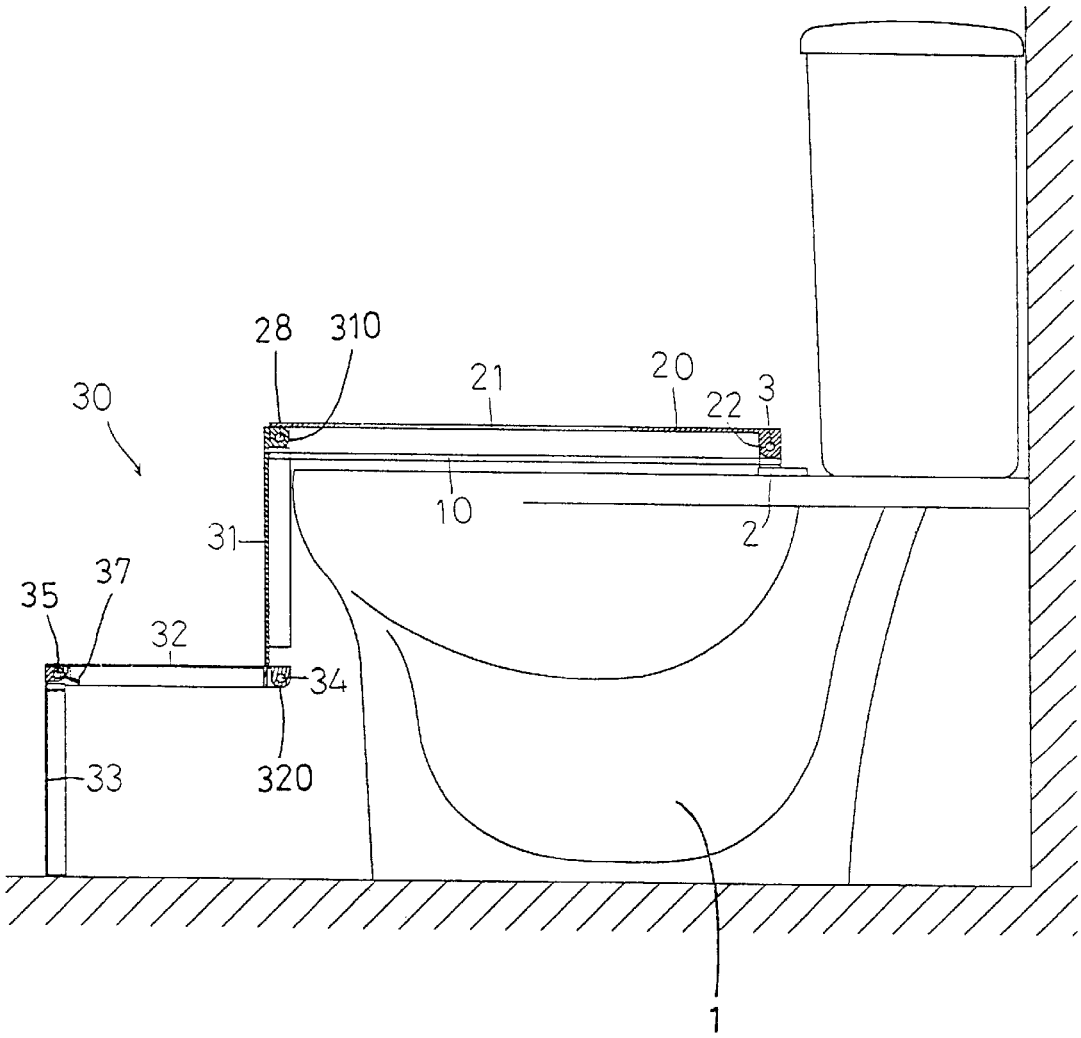
FIG. 2 is a partial cross sectional view taken along lines 2—2 of FIG. 1.
Figure 3:
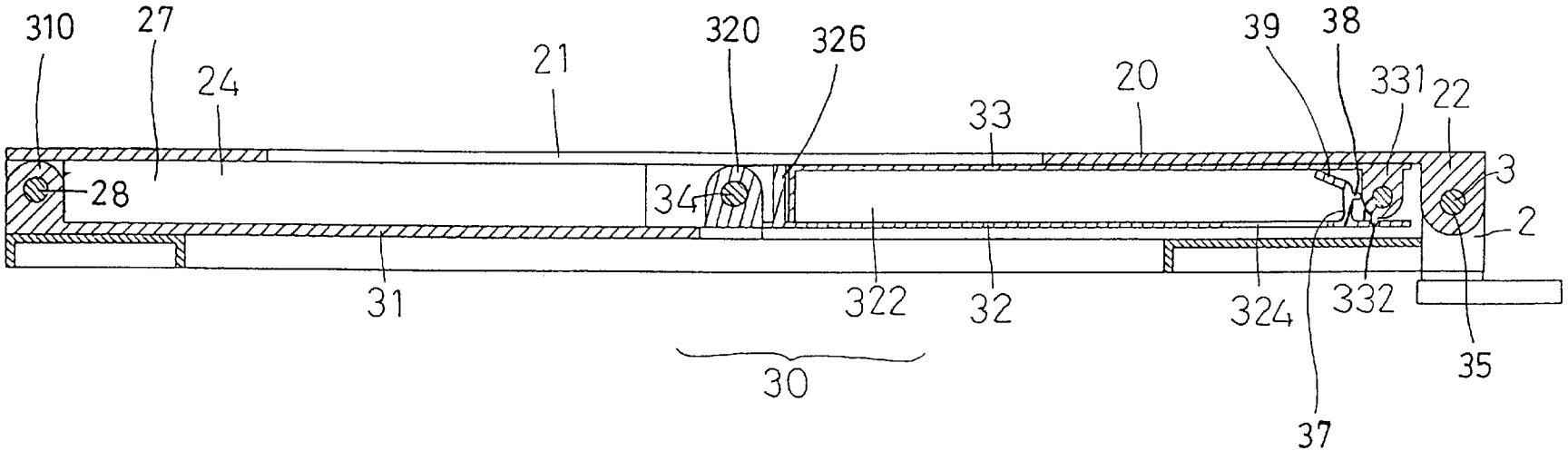
FIG. 3 is an enlarged cross sectional view of the support device, which is in a folded or storing position.

For example, the annular base member 20 includes a single projection 22 provided on the rear portion thereof, and engaged between the ears 12 of the annular seat member 10, and thus also rotatably secured to the bracket 2 of the bowl 1 with the pivot axles 3, such that the annular base member 20 may also be rotated relative to the toilet bowl 1 between an erect position (FIG. 4) and a downward or horizontal position (FIGS. 1–3).

The annular base member 20 includes one or more, such as two swellings 23 formed or provided on one side, such as the front portion thereof, opposite to the projection 22, for forming or defining a space 25 between the swellings 23, and includes a chamber 24 formed in the bottom portion thereof, and formed or defined by an outer and downwardly dependent peripheral wall 27. A shaft 28 may be engaged through the swellings 23, and engaged through the space 25 of the annular base member 20.

The support device 30 further includes a plate 31 having one or more protrusions 310 extended from one side thereof and received in such as the space 25 of the annular base member 20, for allowing the plate 31 to be pivotally or rotatably secured to the front portion of the annular base member 20 with the shaft 28, and for allowing the plate 31 to be received in the chamber 24 of the annular base member 20 or parallel to the annular base member 20, and to be rotated to be perpendicular to the annular base member 20.

The plate 31 includes one or more, such as two juts 311 formed or provided on the other end thereof, opposite to the protrusions 310, for forming or defining a space 313 between the juts 311. A rod 34 may be engaged through the juts 311, and engaged through the space 313 of the plate 31. The plate 31 includes an area about one half (½) of that of the annular base member 20, such that the plate 31 may be received in about one half (½) of the chamber 24 of the annular base member 20.

Figure 4:
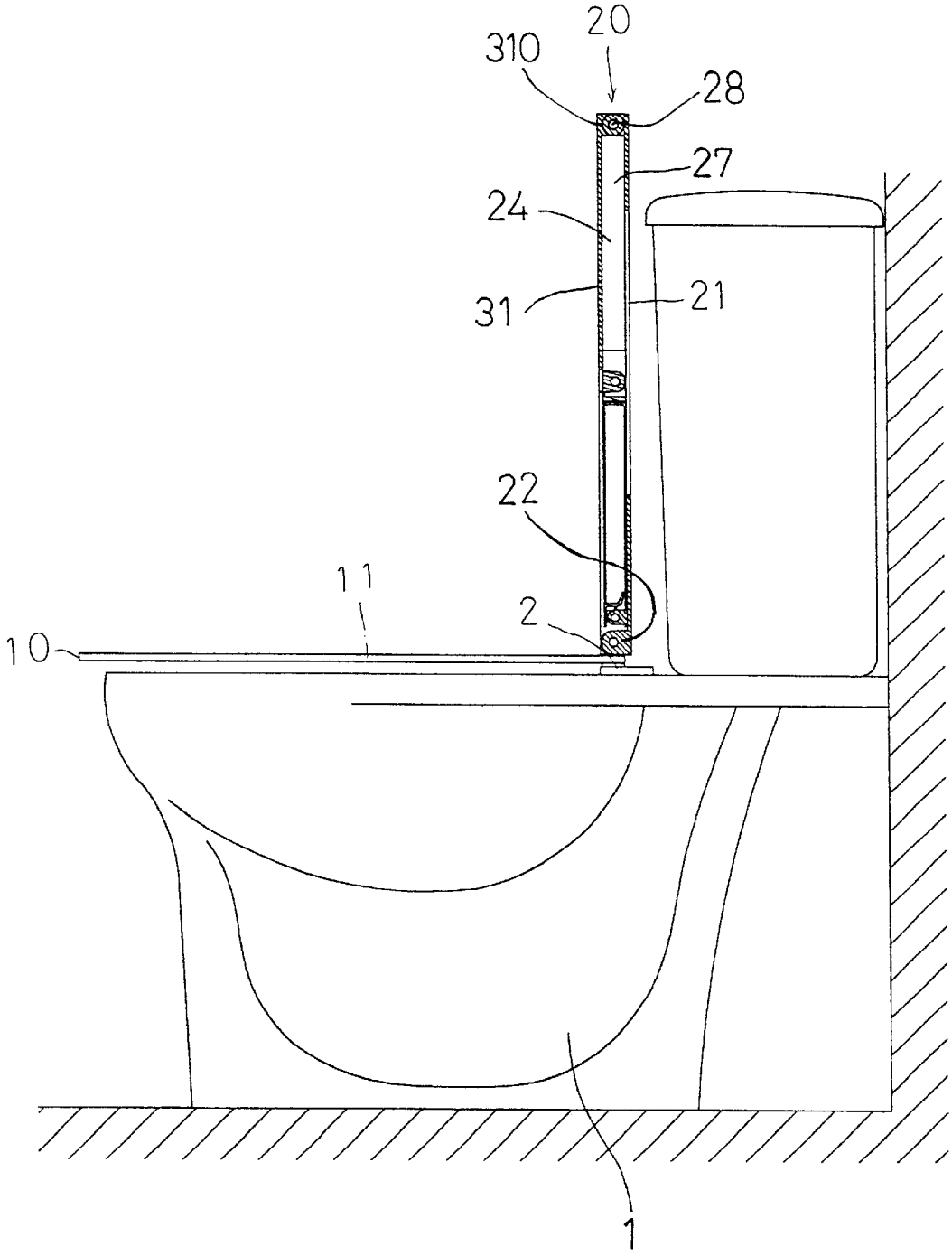
FIG. 4 is a partial cross sectional view similar to FIG. 2, in which the support device is in the folded or storing position, and in an erected position.
Figure 5:
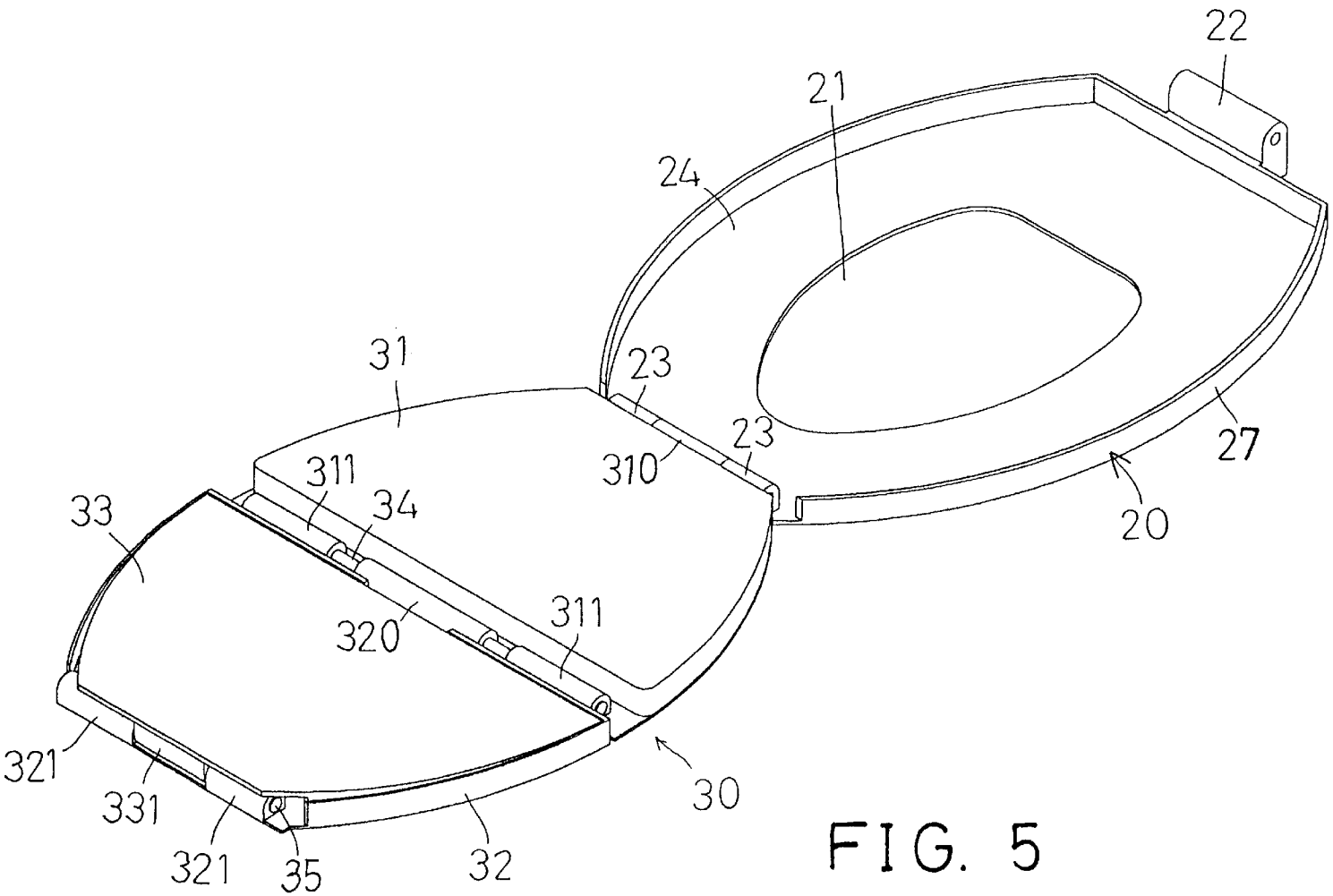
FIG. 5 is a bottom perspective view of the support device, which is in a partially open position.

The support device 30 further includes a board 32 having one or more lumps 320 extended from one side thereof and received in such as the space 313 of the plate 31, and engaged with the rod 34, for allowing the board 32 to be pivotally or rotatably secured to the plate 31 with the rod 34, and for allowing the board 32 to be received in the chamber 24 of the annular base member 20 (FIGS. 3, 4).

The board 32 includes one or more, such as two bulges 321 formed or provided on the other end thereof, opposite to the lumps 320, for forming or defining a space 323 between the bulges 321. A pole 35 may be engaged through the bulges 321, and engaged through the space 323 of the board 32. The board 32 includes an area about one half (½) of that of the annular base member 20, such that the board 32 may be received in the other half (½) of the chamber 24 of the annular base member 20.

The board 32 further includes a chamber 322 formed therein and defined by a peripheral fence 326, and includes an orifice 324 formed therein and communicating with the chamber 322 thereof, and located close to the space 323 and the bulges 321 of the board 32. The board 32 further includes a spring latch 37 extended therefrom and located close to the space 323 that is formed between the bulges 321 of the board 32.

The support device 30 further includes a panel 33 having one or more projections 331 extended from one side thereof and received in such as the space 323 of the board 32, and engaged with the pole 35, for allowing the panel 33 to be pivotally or rotatably secured to the board 32 with the pole 35, and for allowing the panel 33 to be received in the chamber 322 of the board 32.

Figure 7:
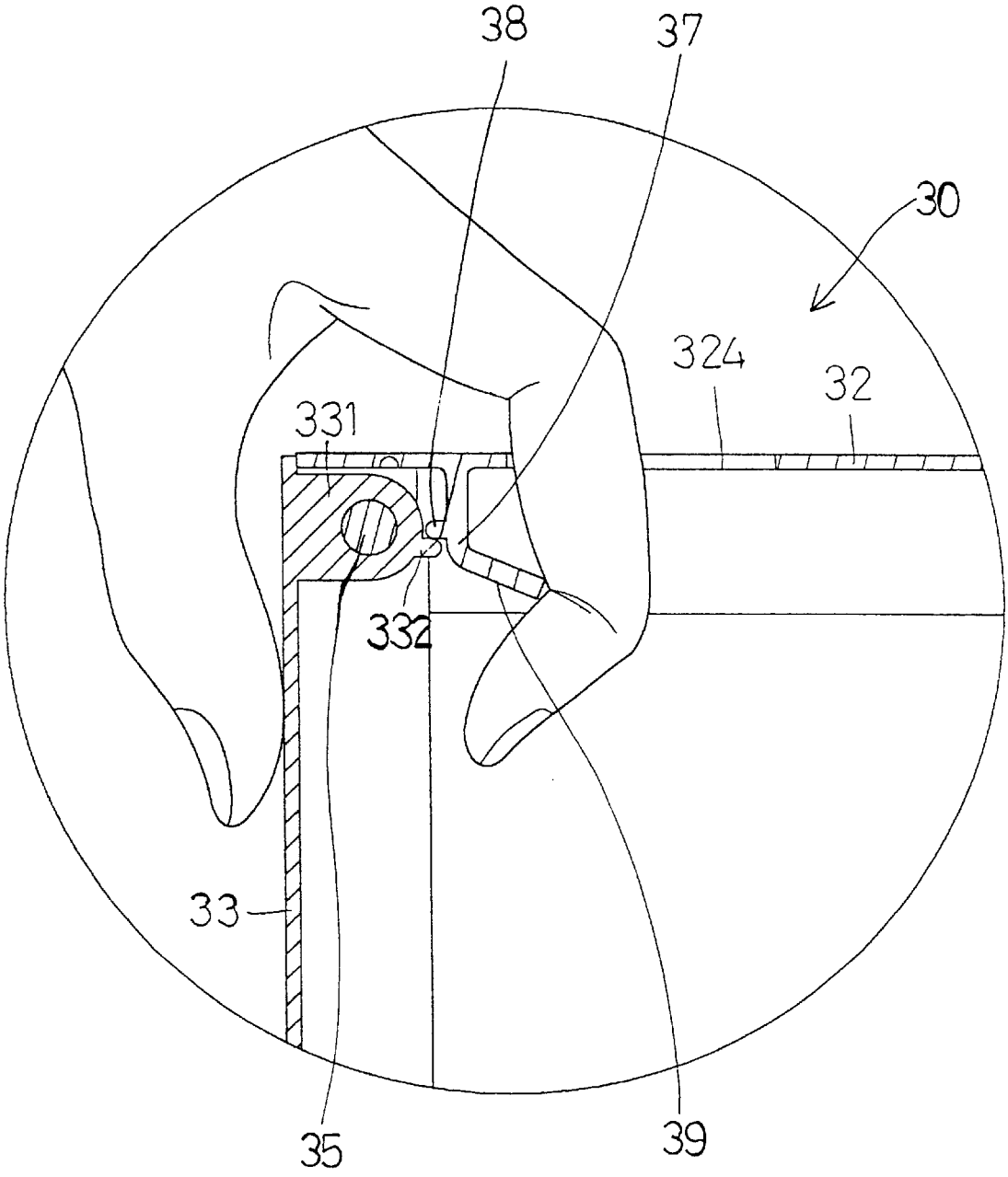
FIGS. 7, 8 are enlarged partial cross sectional views illustrating the operation of the support device for the toilet seat device.
Figure 8:
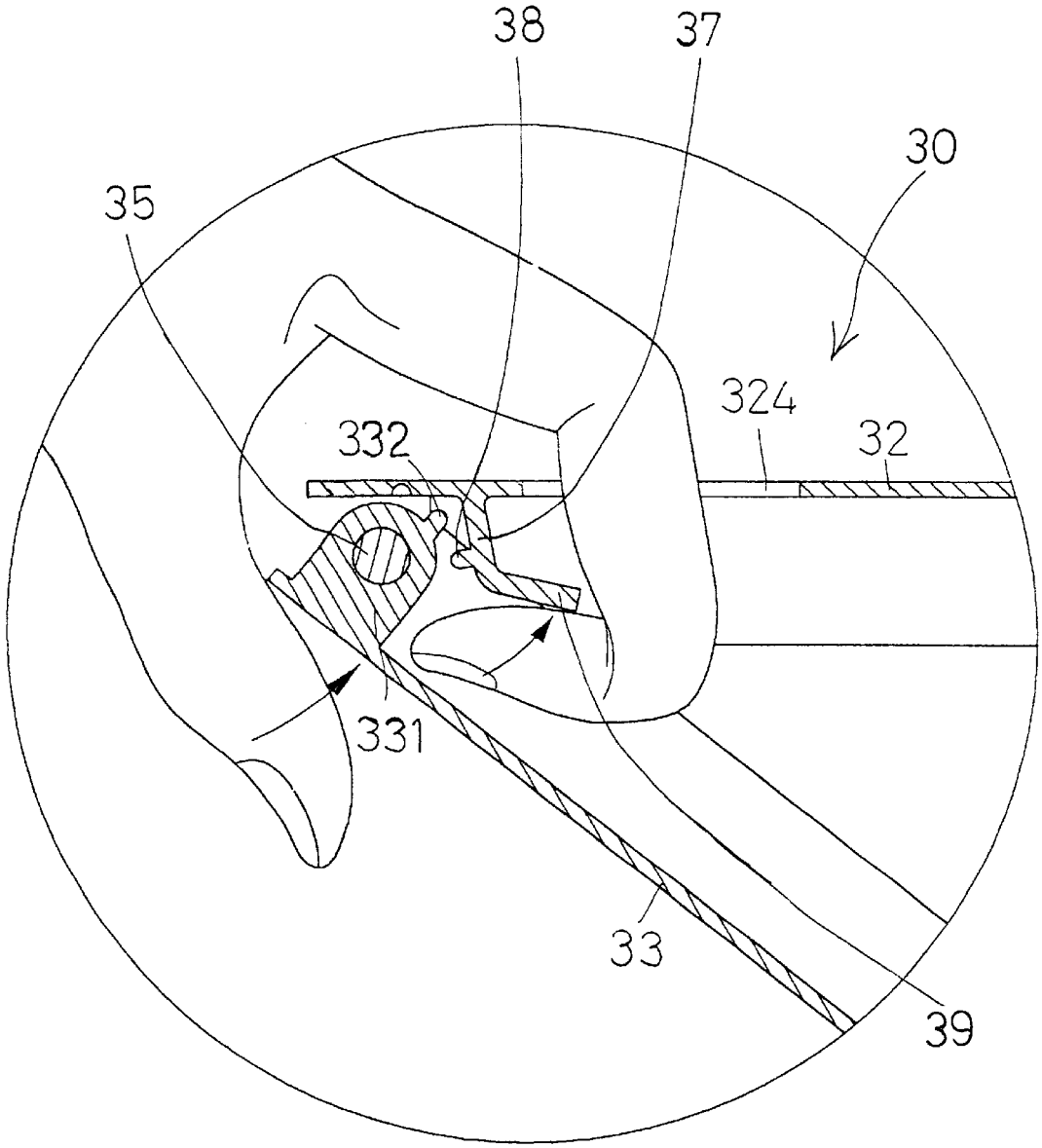

The panel 33 includes one or more stops 332 formed or provided or extended therefrom, best shown in FIGS. 6–8. The spring latch 37 of the board 32 includes one or more catches 38 extended therefrom for engaging with the stops 332 of the panel 33, and for positioning or maintaining the panel 33 at an open position relative to the board 32, in which the panel 33 is perpendicular to the board 32, best shown in FIGS. 1 and 2, and for preventing the panel 33 from folding relative to the board 32, and for elevating the board 32, and for supporting the board 32 at the horizontal working position.

In operation, as shown in FIGS. 1 and 2, the annular base member 20 may be rotated to be supported on top of the toilet bowl 1 or the annular seat member 10, and the plate 31 may be moved out of the chamber 24 of the annular base member 20, and may be dependent downwardly from the annular base member 20 at a position substantially perpendicular to the annular base member 20.

The board 32 may be rotated relative to the plate 31, and perpendicular to the plate 31, in order to form as a foot pedal to support the feet of children. In addition, the panel 33 may be rotated or moved out of the chamber 322 of the board 32, and may be perpendicular to the board 32, to support the board 32 at the horizontal working position, to safely and stably support the feet of the children.

The catches 38 of the spring latch 37 of the board 32 may engage with the stops 332 of the panel 33 (FIG. 7), to position or maintain the panel 33 at the open or perpendicular position relative to the board 32, for preventing the panel 33 from folding relative to the board 32, and thus to stably retain the board 32 at the horizontal working position.

The spring latch 37 of the board 32 includes a hand grip 39 provided on the free end thereof for moving or disengaging the catch 38 thereof from the stops 332 of the panel 33 (FIG. 8), and thus for allowing the panel 33 to be folded relative to the board 32 and to be received in the chamber 322 of the board 32, in the folding or storing position.

It is to be noted that the annular base member 20 may also be sized to support adults and children, and the children may be stably supported on the annular base member 20 with the board 32. Alternatively., the plate 31, and the board 32 and the panel 33 may also be attached to the annular seat member 10, instead of being secured to the annular base member 20.

The engagement of the lumps 320 of the board 32 with the plate 31 may be arranged to support the board 32 at the working position that is perpendicular to the plate 31, and to maintain or retain the board 32 in the perpendicular position relative to the plate 31, such that the board 32 may also be maintained in the horizontal position to safely and stably support the feet of the children, without the panel 33.

Accordingly, the toilet seat device in accordance with the present invention includes a support device that may be used for safely and stably supporting children on the toilet bowl.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A toilet seat device comprising:

a toilet bowl, an annular base member rotatably attached onto said toilet bowl, and including an opening formed therein, means for supporting children on said annular base members said supporting means including a board coupled to said annular base member and movable to a horizontal working position to support the children, a panel attached to said board, to support said board at the horizontal working position, and means for maintaining said panel at a position perpendicular to said board, said maintaining means including a spring latch provided on said board and engageable with said panel to secure said panel to said board.

2. The toilet seat device according to claim 1, wherein said supporting means includes a plate pivotally coupled between said annular base member and said board, and rotatable relative to said annular base member between a first position parallel to said annular base member and a second position perpendicular to said annular base member.

3. The toilet seat device according to claim 2, wherein said annular base member includes a chamber formed therein and defined by a peripheral wall, to receive said plate in said chamber of said annular base member.

4. The toilet seat device according to claim 2, wherein said board is rotatably coupled to said plate with a rod, and rotatable relative to said plate between a first position parallel to said plate and a second position perpendicular to said plate.

5. The toilet seat device according to claim 1, wherein said panel includes a projection rotatably secured to said board with a pole, said spring latch is engageable with said projection of said panel.

6. The toilet seat device according to claim 5, wherein said projection of said panel includes a stop extended therefrom, said spring latch includes a catch extended therefrom and engageable with said stop of said projection of said panel.

7. The toilet seat device according to claim 5, wherein said spring latch includes a hand grip for actuating and disengaging said spring latch from said projection of said panel.

* * * * *